US006766803B2

(12) United States Patent
An

(10) Patent No.: US 6,766,803 B2
(45) Date of Patent: Jul. 27, 2004

(54) METHOD OF MANUFACTURING CIGARETTES CONTAINING GOLD OR SILVER PARTICLES

(76) Inventor: Jung-O An, 105, Sinseong B/D, #283, 6-ga, Dangsan-dong, Yeongdeungpo-gu, Seoul 150-046 (KR)

( * ) Notice: Subject to any disclaimer, the term of this patent is extended or adjusted under 35 U.S.C. 154(b) by 0 days.

(21) Appl. No.: 10/247,346

(22) Filed: Sep. 20, 2002

(65) Prior Publication Data

US 2003/0037791 A1 Feb. 27, 2003

Related U.S. Application Data

(62) Division of application No. PCT/KR01/00288, filed on Feb. 26, 2001.

(30) Foreign Application Priority Data

Mar. 21, 2000 (KR) ..... 2000-14393

(51) Int. Cl.[7] ..... A24B 15/00
(52) U.S. Cl. ..... 131/309; 131/300
(58) Field of Search ..... 131/309, 290, 131/300

(56) References Cited

FOREIGN PATENT DOCUMENTS

| | | | |
|---|---|---|---|
| JP | 76026518 | * | 8/1976 |
| JP | 56-85275 | | 7/1981 |
| KR | 1987-0000839 | | 4/1986 |
| KR | 1996-0009916 | | 4/1996 |

OTHER PUBLICATIONS

English Language Abstract of JP 56–85275.
English Language Abstract of KR 1987–0000839.
English Language Abstract of KR 1996–0009916.

* cited by examiner

*Primary Examiner*—Dionne A. Walls
(74) *Attorney, Agent, or Firm*—Greenblum & Bernstein, P.L.C.

(57) ABSTRACT

The present invention relates to cigarettes containing gold or silver particles and manufacturing methods of cigarette filters. The tobacco leaves, added with ion particles of gold, are prepared through blending them with peach leaves or bellflower leaves, which contains tartaric acid and malic acid as major components; the cigarette pouches comprise 20% of peach leaves or bellflower leaves and the gold or silver particles prepared in 0.005~0.015 micron m of their size; and the filters are prepared by soaking them in a liquid mixture of pulverized peach leaves, bellflower leaves, and charcoals in more than 800 meshes. Therefore, in smoking, the cigarettes and their filters in this invention produce beneficial effects such as detoxification, blood-refining, and cell-cleaning with their major components such as gold particles, tartaric acid, and malic acid being absorbed into one's lung.

2 Claims, No Drawings

METHOD OF MANUFACTURING CIGARETTES CONTAINING GOLD OR SILVER PARTICLES

This application is a continuation-in-part of International Application No. PCT/KR01/00288, having an international filing date of Feb. 26, 2001, designating the United States of America, and published under PCT Article 21(2) in the English language, the contents of which are expressly incorporated by reference in its entirety.

TECHNICAL FIELD

The present invention relates to a method for making cigarettes containing gold or silver particles, and more particularly, to a method for manufacturing cigarettes, wherein the tobacco leaves, added with ion particles of gold or silver, are prepared through blending them with peach leaves or bellflower leaves, which contains tartaric acid and malic acid as major components; the cigarette pouches comprise 20% of peach leaves or bellflower leaves and the gold or silver particles having purity of 99.9% prepared in 0.005–0.015 micron of their size; and the filters are prepared by soaking them in a liquid mixture of pulverized peach leaves, bellflower leaves, and charcoals in more than 800 meshes.

BACKGROUND ART

Generally, according to an investigation result, the relation of a smoking cigarette per day with a lung cancer is as follows: in case of 35–84 year-old men, the number of lung-cancer patients who have habitually smoked more than 20 cigarettes per day is 6 times more than that of those who are not smoking, and in case of more than 40 cigarettes per day, 12.6 times more. Also, one who is smoking since 15 year olds or before has a lung cancer 5 times more than one who is smoking since 20 year olds or before.

That is, when one is young, when his/her lung is not completely matured, he/she is apt to have a lung cancer. Also, if smoking, the artery which circulates blood to a muscle of heart becomes narrow and the nutritious oxygen fails to be supplied to the muscle of heart, and thus a myocardial (cardiac) infraction or heart attack is likely to occur in the condition.

Also, in the relation of mortality due to disease with smoking rate, according to the assertion of some U. S. doctors, suppose one who is not smoking is 1, one who is smoking in less than 10 cigarettes is 2.35 times, one who is smoking in 10–19 cigarettes is 3.0 times, one who is smoking in 20–29 cigarettes is 3.11 times and one who is smoking in more than 40 cigarettes is 3.5 times.

For example, heavy smokers are apt to have bronchial trouble or bronchitis. A bronchial tube is a passage through which air is transferred to a lung and the cigarette smoke passes through the passage, and thus the cigarette smoke has the greatest influence on the bronchial tube. As chronic bronchitis becomes, the resilience of the lung is going down little by little. That is, tar in the smoke, which contains stimulating materials or noxious gases, influences on the mucous membrane of bronchial tube, and this disease is called emphysema of the lungs.

Due to influence of nicotine, the secretion of gastric juices loses balance, the occurrence of gastric (stomach) ulcer or the duodenum becomes two times than the ordinary person.

In the state of maternity, carbon monoxide or hemoglobin in the blood is conveyed into the unborn baby through the placenta. In case of non-smoking female, the rate of sterility is 4.6%. The rate of sterility for heavy-smoking female is 5.4% and is higher than that of non-smoking female. Also, for non-smoking female, the rate of abortion is 15.3%, while the rate of abortion for heavy-smoking female is 37.3% and is 2 times higher than that of non-smoking female. Also, the weight of newborn infant for heavy-smoking female is lighter than that of nonsmoking female.

Also, the cigarette is widely known to injure human health. According to a report of the WHO, the number of deaths due to smoking will be increased to three times within 20 years, from three millions to ten millions. About half of the whole smoker will be eventually died due to smoking, half of deaths due to smoking will be died at middle age, causing the smoking to shorten the average span of human life to about 25 years. Thus, smoker is higher than non-smoker in the risk of death before 70 years old.

Also, the disease occurred due to smoking becomes causes of geriatric disease such as cancers, hypertension, apoplexy, cerebral infarction, respiratory disease. As above mentioned, since smoking delivers fatal blow to the health of human, antismoking campaign is conducted throughout the world.

But, smoking is known to harm the health, some smoker think smoking is helpful to refill vital power, in contemplating, studying, depressed or lonely.

Due to such causes, many attempts are done to remove or reduce damages due to smoking.

For example, the leaf tobacco is chemical-treated to reduce noxious substances such nicotine, tar. Various types of tobacco pipes installed with cha col, smoke and tar absorbers and various filters are advent. Also, various quality of filters attached to the cigarette are proposed, but remarkable effects are not obtained.

Besides, in Korea, patent application or granted patent relating to ginseng cigarettes, bellflower cigarettes, danggwi cigarettes has been filed. But, inherent incense or the extract from ginseng, bellflower, danggwi is only added to the cigarettes, it is not disclosed how the substances are interacted with the effective substances of the cigarette in smoking.

DISCLOSURE OF INVENTION

Therefore, in considering said problems of candles in the art, the object of the present invention is devised to provide a method for manufacturing cigarettes containing gold or silver particles, which is capable of alleviating bad properties, activating human cells and providing detoxification.

Another object of the present invention is provide a method for manufacturing cigarettes containing gold or silver particles, which is capable of producing beneficial effects such as detoxification, blood-refining, and cell cleaning with their components such as gold particles, tartaric acid, and malic acid being absorbed into one's lung, in smoking.

The present invention was achieved by providing a method of manufacturing a filter of a leaf tobacco, which comprises the steps of: pulverizing peach and bellflower leaves which are pounded and dried by steam, with charcoals in more than 800 meshes, to a fine powder; and adding the pulverized powder to the filter. According to other embodiment, the method comprises pulverizing charcoals, peach and bellflower leaves together with water; soaking the filter into a liquid mixture of the pulverized ingredients; and drying the filter.

Preferably, the method further comprises spraying at least 3 ppm of gold ionic water or at least 3 ppm of silver ionic water on the filter, such that the filter contains gold or silver ionic water.

In the preferred embodiment, a method for manufacturing cigarettes containing gold or silver particles, comprises the steps of: pulverizing peach and bellflower leaves together with water; blending a liquid mixture of the pulverized ingredients with at least 3 ppm of gold or silver ionic water; soaking tobacco leaves into the blended liquid mixture; and drying the tobacco leaves. According to other embodiment, the method comprises spraying at least 3 ppm of gold or silver ionic water on the tobacco leaves; pulverizing peach and bellflower leaves which are pounded and dried by steam; and blending the pulverized powder with the sprayed tobacco leaves. Preferably, this method further comprises the step of soaking the tobacco leaves into ozone water for 30 minutes to remove agricultural chemicals.

In another preferred embodiment, a method for manufacturing cigarettes containing gold or silver particles comprises the steps of: preparing a tobacco pouch by isolating fibroid materials from pulp, bagasco, flax plant, hemp plant or jute; blending at least 3 ppm of gold or silver ionic water having 99.9% of gold or silver purity and 0.005~0.015 micron of particle size, with pulverized liquid mixture of peach and bellflower leaves and water; and mixing the blended liquid mixture with the fibroid materials when preparing the tobacco pouch or spraying the blended liquid mixture on the prepared tobacco pouch.

BEST MODE FOR CARRYING OUT THE INVENTION

Below, the example provides a more detailed description of a preferred embodiment of the present invention.

A major aspect of the present invention is providing a less hazardous cigarette containing effective ingredients such as tartaric acid and malic acid contained in peach and bellflower leaves, and gold or silver particles, thereby reducing damages by smoking and protecting human health.

Each component of cigarette, i.e. a filter, tobacco leaf and pouch, contains gold or silver particles, peach and bellflower leaves in the form of powder or liquid mixture. Especially, the filter further contains charcoals of more than 800 meshes.

The gold or silver ionic water used in the present invention, is prepared by electrolyzing the gold or silver having purity of 99.9% in pure distilled water or purified water with electrical source of 28~45V DC, and dispersing gold or silver particles into colloidal phase in which each particle size is 0.005~0.015 micron. The concentration of gold of silver ionic water is preferably 3 ppm.

First, the cigarette filter is prepared as following processes. To add peach and bellflower leaves to the filter, they are pounded and dried by steam. Then they are pulverized in more than 800 meshes with another additive, i.e. charcoals. Finally, these powders are added to the filter. Other method is to add them in the form of liquid mixture to the filter. To produce the liquid mixture, the three components are pulverized in water. The filter is soaked in the aqueous mixture and dried.

The manufactured filter adsorbs nicotine or tar substances of the cigarette and neutralizes them, and tartaric and malic acids of peach and bellflower leaves are helpful to detoxification of noxious materials.

When preparing the filter, preferably, at least 3 ppm of gold ionic water or at least 3 ppm of silver ionic water is sprayed on the filter, such that the filter contains gold or silver ionic water.

Second, the tobacco leaf is prepared as following processes. When drying the harvested tobacco leaves, they are soaked in the liquid mixture prepared by pulverizing peach and bellflower leaves in water, and blending at least 3 ppm of gold or silver ionic water with the pulverized solution. They finally are dried after soaking. Instead of soaking method, it is also possible that at least 3 ppm of gold or silver ionic water is sprayed on the tobacco leaves and the pulverized powders of peach and bellflower leaves are mixed with the sprayed tobacco leaves.

When preparing the tobacco leaf, preferably, the tobacco leaf is soaked into ozone water for 30 minutes to remove agricultural chemicals.

Third, the tobacco pouch is prepared as following processes. The major raw materials of the tobacco pouch are fibroid materials isolated from pulp, bagaseo, flax plant, hemp plant or jute. The liquid mixture added to the tobacco pouch is prepared by blending at least 3 ppm of gold or silver ionic water having 99.9% of gold or silver purity and 0.005~0.015 micron of particle size, with pulverized solution of peach and bellflower leaves and water. This liquid mixture is mixed with the fibroid materials when preparing the tobacco pouch or sprayed on the prepared tobacco pouch.

The cigarettes manufactured from independently prepared filter, tobacco leaf and pouch as above, when smoking them, produce beneficial effects such as detoxification, blood-refining, and cell cleaning with their major components such as gold particles, tartaric acid, and malic acid being absorbed into one's lung.

Meanwhile, poly aromatic hydrocarbons (PAH) are aromatic compounds having at least two benzene rings. In nature, PAH having 2–4 benzene rings exists in the form adsorbed on gas or solid. PAH having at least 5 benzene rings exists in the form mainly adsorbed on solid. According to physical properties of PAH compounds, they have low solubility in water and high solubility in organic solvent. They are absorbed into a human body in the form adsorbed on particles since they have comparatively low vapor pressure. Especially, PAH compounds having a size less than 1.0 micron are easily absorbed into the human body.

It is known that long periodic exposure to carcinogenic materials is more important than short periodic exposure to the same in relation with general noxiousness of PAH. The exposure to PAH is serious to one who lives near hazardous waste treatment facilities, incinerator, and automobile crowded zone. PAH compounds are absorbed into all human tissues including fatty materials and accumulated in a kidney, liver and so on. The most of PAH compounds are discharged through secretions or excretions from the body In various studies, benzo[a]pyrene, benz[a]anthracene, benzo[b]fluoranthene and dibenz[a,h]anthracene among PAH compounds are known as noxious materials causing carcinogenesis. Especially, these compounds are also detected in cigarette smoke.

In the present invention, the influence of gold or silver treatment on the PAH compounds was investigated. As a result, the content of PAH compounds in cigarette smoke was lower in a group of gold or silver treatment than groups of distilled water treatment and non-treatment. Therefore, it is assumed that gold or silver treatment of cigarette may remove or reduce PAH compounds in cigarette smoke.

The above examples are offered to illustrate this invention and are not meant to be construed in any way as limiting the scope of this invention. An expert in the art can sufficiently understand desirable examples of the present invention. Also, the range of the present invention must be decided by the following claims based on technical concept of the present invention.

INDUSTRIAL APPLICABILITY

As explained through the above example, the cigarette has high habituation as favorite foods. Therefore, the cigarettes and their filters in this invention, when smoking them, produce beneficial effects such as detoxification, blood-refining, and cell-cleaning with their major components such as gold or silver particles, tartaric acid, and malic acid being absorbed into one's lung. Thus the present invention is useful for the cigarette industry.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing cigarettes containing one of gold and silver particles, comprising:

one of pulverizing peach and bellflower leaves together with water, blending a liquid mixture of the pulverized ingredients with at least 3 ppm of one of gold and silver ionic water, soaking tobacco leaves in the blended liquid mixture, and drying the tobacco leaves; and spraying at least 3 ppm of one of gold and silver ionic water on tobacco leaves, pulverizing pounded and steam-dried peach and bellflower leaves into a powder, and blending the pulverized powder with the sprayed tobacco leaves.

2. The method for manufacturing cigarettes containing one of gold and silver particles as claimed in claim 1, further comprising soaking the tobacco leaves in ozone water for 30 minutes to remove agricultural chemicals.

* * * * *